United States Patent [19]

Baumann

[11] Patent Number: 4,888,835

[45] Date of Patent: Dec. 26, 1989

[54] SPLASHGUARD FOR A BATHTUB

[75] Inventor: Heinz Baumann, Zurich, Switzerland

[73] Assignee: Spirella AG, Embrach, Switzerland

[21] Appl. No.: 293,636

[22] Filed: Jan. 5, 1989

[30] Foreign Application Priority Data

Jan. 6, 1988 [CH] Switzerland ..... 033/88

[51] Int. Cl.[4] ..... A47K 3/22

[52] U.S. Cl. ..... 4/609; 4/607; 4/614; 4/605

[58] Field of Search ..... 4/607, 608, 609, 605, 4/559, 610, 612, 614, 597, 596; 49/409–411

[56] References Cited

U.S. PATENT DOCUMENTS

| | | | |
|---|---|---|---|
| 1,944,440 | 1/1934 | Lehman | 4/607 X |
| 1,971,802 | 8/1934 | Zechiel | 4/609 |
| 2,032,180 | 2/1936 | McCord | 4/609 X |
| 2,748,908 | 6/1956 | Jacobson et al. | 4/607 X |
| 2,776,439 | 1/1957 | Rondinelli | 4/608 X |
| 2,864,096 | 12/1958 | Garber | 4/608 X |
| 3,000,016 | 9/1961 | Ridge | 4/608 X |
| 3,074,077 | 1/1963 | Taubman | 4/607 |
| 3,449,770 | 6/1969 | Casebolt | 4/607 |
| 4,090,265 | 5/1978 | Baus | 4/607 |
| 4,594,741 | 6/1986 | Payne | 4/608 |

FOREIGN PATENT DOCUMENTS

| | | | |
|---|---|---|---|
| 0018299 | 4/1979 | European Pat. Off. | 4/607 |
| 0140329 | 5/1985 | European Pat. Off. . | |

*Primary Examiner*—Henry K. Artis

*Attorney, Agent, or Firm*—Frishauf, Holtz, Goodman & Woodwrd

[57] ABSTRACT

A splashguard for a bathtub comprises a substantially flat, substantially rectangular panel member (1), with a flange (2) extending at least laterally on both opposite sides thereof and on the bottom thereof. At least the outer edge portion of the flange is substantially perpendicular to the panel member. On its upper end the splashguard is movably suspended from an adjustable-length guide rail (20) which can be braced against opposing walls of the bathroom, whereby its height can be so selected that the lower flange of the splashguard is slidable on the upper surface (11) of the rim (12) of the bathtub. An extension (5), extends from the lower part of the splashguard below the upper surface of the rim of the bathtub and rests against the inner face (13) of the bathtub, and has at least one magnetic element (6) thereon which magnetically adheres to the inner face (13) of a bathtub made of sheet steel or the like. Bathtubs made of plastic material are provided on the inner face (13) with a narrow steel strip (preferably plastic coated) mounted at the height of the magnetic element (6) so that the magnetic element (6) can adhere to the steel strip.

19 Claims, 5 Drawing Sheets

SPLASHGUARD FOR A BATHTUB

BACKGROUND OF THE INVENTION

The present invention relates to a movably suspended splashguard for a bathtub, comprising a substantially flat, substantially rectangular panel member having a flange adjoining the substantially flat portion thereof, and extending at least on the sides and on the bottom thereof, whereby the flange at the bottom of the splashguard is slidable on the upper surface of the rim of the bathtub.

If bathtubs are additionally provided with a shower arrangement and—as it happens quite often—are used extensively for showering, it becomes necessary to provide the bathtub with a splashguard.

The simplest arrangement of such a splashguard comprises a rod or rail, running parallel to the rim of the bathtub and braced by spring pressure against two opposing walls of the bathroom, from which a curtain is suspended. Such a splashguard is distinguished by its ease of mounting and removal. Since the air in the shower area gets heated during the shower, an upwardly directed air movement (i.e., an upward draft) is created which leads to a wafting or rising of cold air over the rim of the bathtub. Thus, there is a tendency for the shower curtain to be peeled or pulled away from the rim of the bathtub and unpleasantly be blown towards the legs of the showering person, while at the same time the efficiency of the splashguard is reduced.

In other arrangements the splashguard is comprised of solid, mostly flat panels or segments which permit sliding, swinging or folding movement and which form a totally or partially enclosed shower stall. For example, EP No. 0 018 299 depicts a splashguard comprised of one or several movably suspended or folding panels, whereby one or two of the panels is not flat, but curved or dome-shaped, thus making for a correspondingly enlarged showering space.

However, all of these arrangements have supporting structural members (frames, rails, uprights, etc.), which are solidly connected to the walls of the bathroom. In arrangements containing sectionalized components which are movable, it is additionally necessary to guide the sectionalized components also on the bottom, which necessitates the mounting of guide rails or guide strips on the rim of the bathtub. All of this results in a relatively expensive installation and has the effect that permanent markings remain when the splashguard is removed.

It is the object of the present invention to eliminate the above disadvantages of the prior art, and more specifically to provide a splashboard which can be just as easily mounted, removed, etc., without leaving any markings, as a shower curtain, whereby the splashguard adheres always with adequate strength to the inner wall of the bathtub, yet, at the same time, can, without any difficulty, be shifted or removed, for cleaning purposes, from the rim of the bathtub.

SUMMARY OF THE INVENTION

According to the present invention, movably suspended splashguard for a bathtub, comprising a substantially flat, substantially rectangular panel member having a flange adjoining and extending from panel member at least laterally on the opposite sides thereof and on the bottom thereof, the flange portion at the bottom of the splashguard being slidable on an upper surface of a rim of the bathtub. The flange is directed inwardly toward the interior of the bathtub and has at least an outer edge portion which extends substantially perpendicular to the panel member of the splashguard; and the flange portion at the bottom of the splashguard has an extension extending below the upper surface of the rim of the bathtub, the extension having a magnetic means for magnetically adhering to an inner face of the rim of the bathtub to fix the position of the splashguard relative to the bathtub.

DETAILED DESCRIPTION

Figure 1:
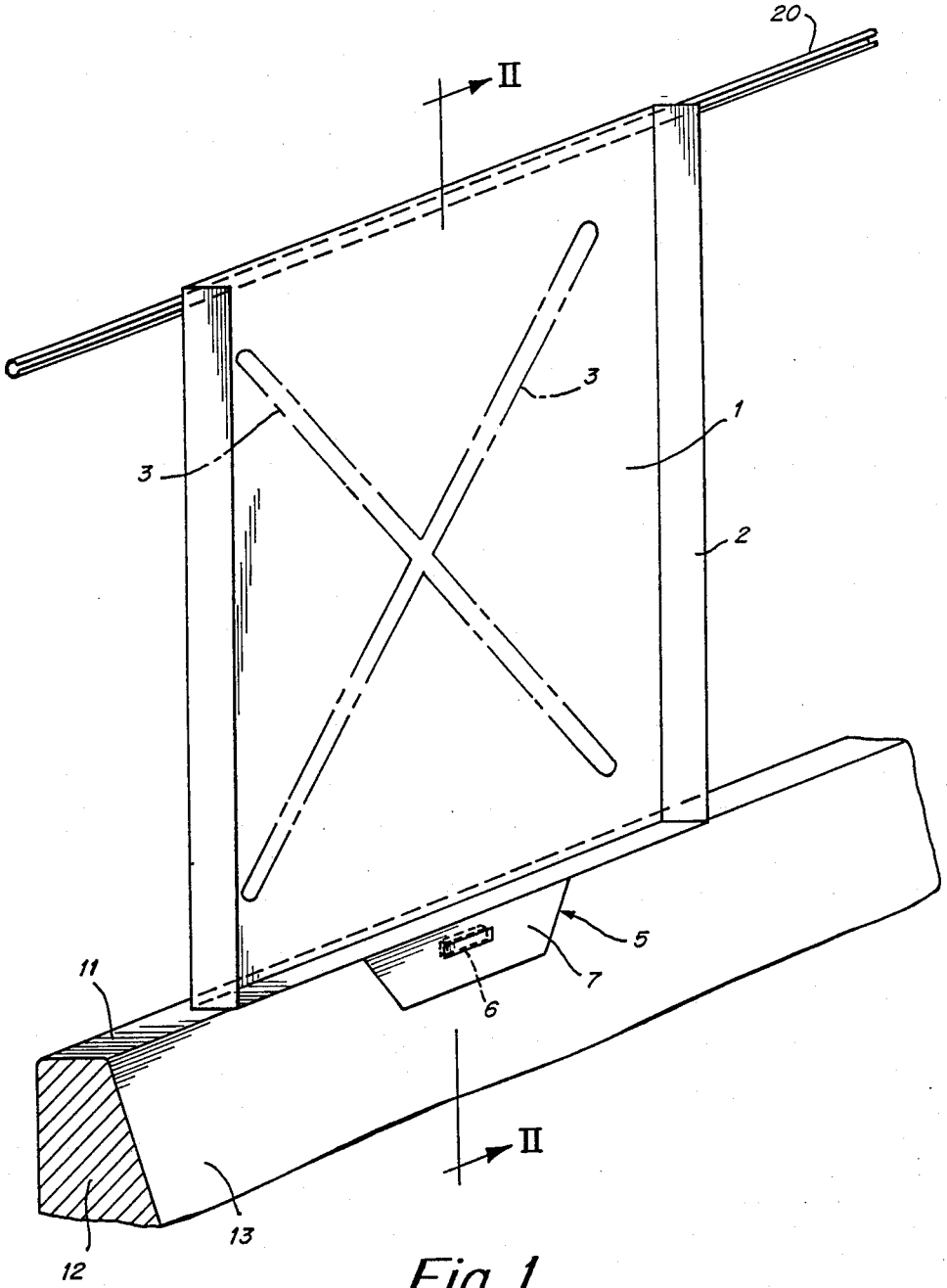
FIG. 1 shows the basic construction of a splashguard according to the present invention.

FIG. 1 shows the basic construction of a splashguard according to the present invention which is movably suspended from an upper guide rail or rod 20. The guide rail 20 runs parallel to an upper rim 12 of the bathtub. The splashguard comprises a substantially flat, substantially reçtangular panel member 1 having a flange or skirt 2, directed inwardly toward the interior of the bathtub, the flange or skirt 2 being provided on both opposite sides and on the bottom of panel member 1. In order to prevent splashing of the water striking the substantially flat panel member 1, the skirt or flange 2 extends approximately perpendicularly to the substantially flat panel member 1 and inwardly toward the interior of the bathtub. The height of the guide rail 20 is so selected that the flange 2 on the bottom end of the panel member 1 of the splashguard slidably moves over the upper surface 11 of the rim 12 of the bathtub in such a way that, on the one hand, a sliding movement of the splashguard is possible, while on the other hand no gap between the lower edge of the splashguard and the upper surface 11 of the rim 12 of the bathtub is created through which water could escape. In order to keep the splashguard in a fixed position, the flange 2 is provided at the bottom portion of the splashguard with an extension or lip member 5 which extends below the upper surface 11 of the rim 12 of the bathtub and which bears on or contacts the inner face 13 of the bathtub. The extension 5 comprises, in its simplest form, a substantially flat face portion 7 which is additionally provided with a magnetic element 6. In the case of the common bathtub made of sheet metal, the magnetic element 6 magnetically adheres to the enameled or otherwise coated inner face 13 of the rim 12 of the bathtub and has the effect that the splashguard cannot swing or rotate around the guide rail 20 in a direction toward or against the bathtub. In the case of plastic bathtubs, a narrow steel strip, e.g. plastic coated (not shown) is attached to the bathtub (for example using a double sided adhesive tape or other adhesive means) at the height of the magnetic element 6 on the inner face 13 of the rim of the bathtub. The magnet 6 will then magnetically adhere to such narrow steel strip.

The extension 5 preferably extends (lengthwise) over only a part of the lower flange 2 of the splashguard. Thereby it is possible to shift or slide the splashguard all the way to the end of the bathtub without the extension 5 coming to (and interfering with) the usually rounded-off end of the bathtub. For mechanical reinforcement of the splashguard, the substantially flat panel member 1 can be provided with stiffener ribs 3, for example provided in an "X" pattern as shown in FIG. 1. The stiffener ribs 3 may be members embedded in panel member 1, or may be raised integral portions of panel member 1 provided on the front or rear surface thereof.

Figure 2A:
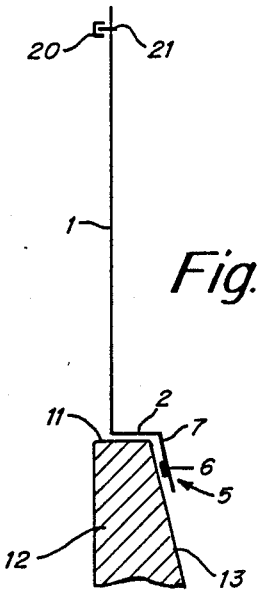
FIG. 2*a* is a cross-section through the splashguard of FIG. 1, taken along line II—II in FIG. 1.

FIG. 2*a* shows a cross-section through the center of the splashguard of FIG. 1. The face 7 of the extension 5 is inclined relative to the panel member 1 of the splashguard in such a way, that it runs substantially parallel to the inner face 13 of the rim 12 of the bathtub. The guide rail 20 is preferably a telescopically extending guide rail, braced between two opposing walls (not shown) of the bathroom by means of spring pressure, and provided with a through-running lateral slot 22, as is known from EP-A No. 0 140 329 (See FIG. 3), the entire contents of which are incorporated herein by reference. By means of at least two glides 21 which are solidly connected to the upper portions of the splashguard and which are configured to slide in the lateral slot 22 of the guide rail 20, the splashguard can be shifted or moved parallel to the rim 12 of the bathtub to shift the position thereof.

Figure 2B:
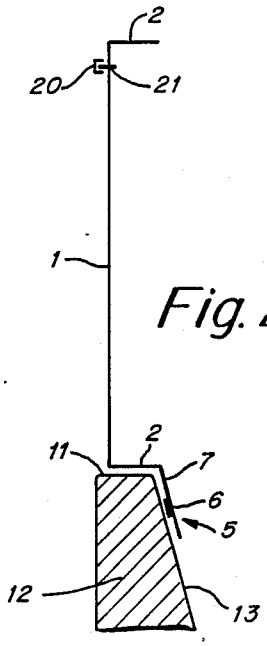
FIG. 2*b* is a corresponding section through a modified splashguard with surrounding flange.

For reasons of stability, the flange 2 preferably encircles the panel member 1 not only laterally (i.e, on both opposite) sides and on the bottom, but it is also preferably provided at the top so as to form an all-around skirt or flange, as shown in FIG. 2*b*.

Figure 2C:
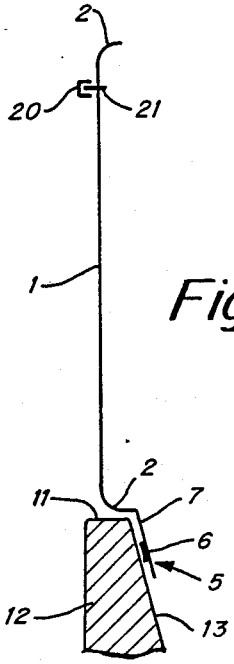
FIG. 2*c* is a corresponding section through a further modified construction of a splashguard according to the present invention.

FIG. 2*c* shows a corresponding section through a further embodiment of the present invention, in which the all-around or circumferential flange 2 is made in the form of a curved arch, and wherein the outer edge of the flange 2 is preferably substantially at a right angle relative to the panel member 1 of the splashguard.

Figure 3:
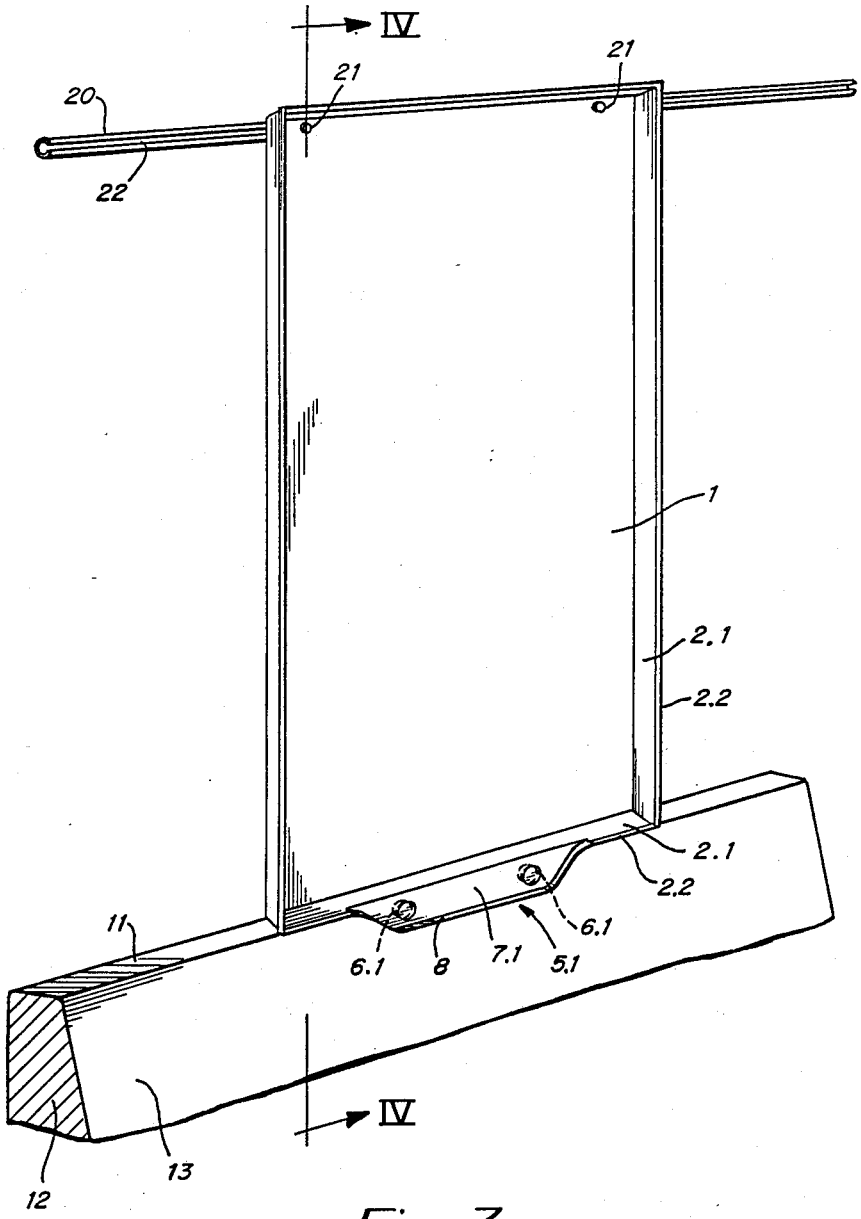
FIG. 3 is a perspective view of a preferred design of the splashguard.
Figure 4:
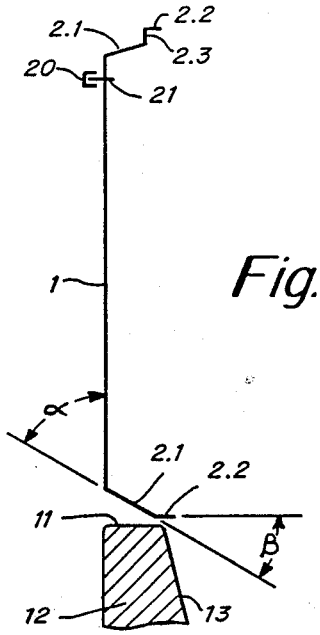
FIG. 4 is a cross-section through the splashguard of FIG. 3, taken along line IV—IV in FIG. 3.

FIG. 3 shows a perspective view of another embodiment of the present invention in which the skirt or flange 2 is made in the form of two circumferential flange sections 2.1 and 2.2. FIG. 4 shows a longitudinal section through FIG. 3 along the line IV—IV, and more clearly shows that the inner flange section 2.1, adjacent to the panel member 1 of the splashguard, is inclined relative to the panel member 1 by a first angle $\alpha$. The outer flange section 2.2, which is preferably narrower than the inner flange section 2.1, is inclined relative to the inner flange section 2.1 by a second angle $\beta$. The angle $\beta$is selected so that the outer flange section 2.2 is at an angle of approximately 90° relative to the panel member 1. Through experiments it has been proven that the waterspray striking the panel member 1 can be best returned to the bathtub if the angle $\alpha$ between 40° and 75°, and is preferably 6020. The upper flange portion (across the top end of panel member 1) is preferably additionally stiffened, e.g. by providing an additional flange section 2.3 (see FIG. 4) between the inner flange section 2.1 and the outer flange section 2.2.

Figure 5:
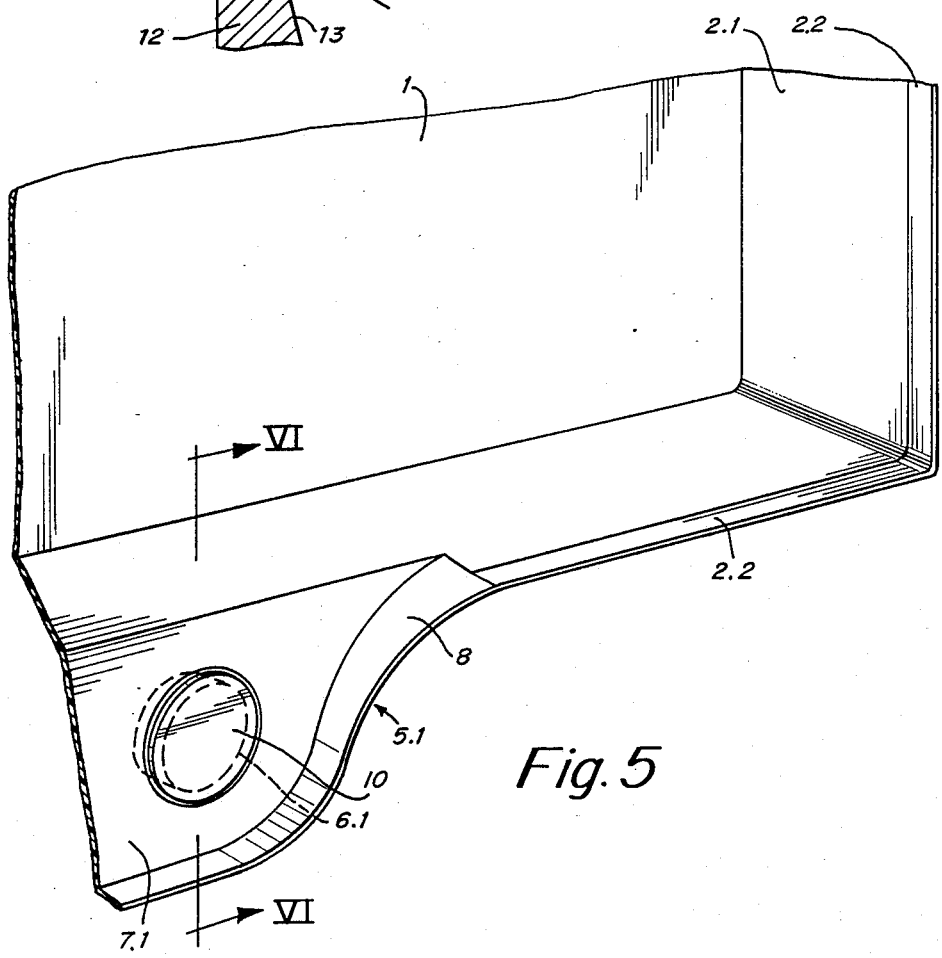
FIG. 5 is a view detailing the extension corresponding to the design of FIGS. 3 and 4.

FIG. 5 shows a perspective view of the extension 5.1 used in the construction of the invention according to FIGS. 3 and 4. The face 7.1 of the extension 5.1 has a lower and lateral skirt or rim (or flange) 8 which extends substantially perpendicular to the panel member 1 of the splashguard and which blends into the outer flange section 2.2, as seen in FIG. 5. For the sake of better stabilization of the splashguard, two magnetic elements 6.1 are used.

Figure 6:
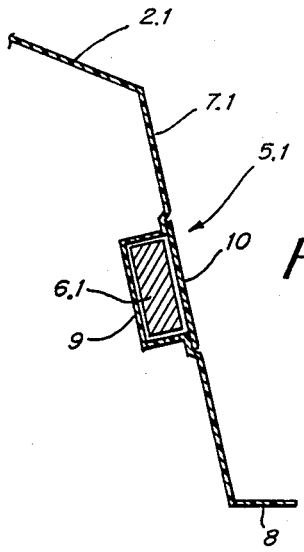
FIG. 6 is a cross-section through the extension of FIG. 5, taken along line VI—VI in FIG. 5, to show the positioning of the magnetic elements.

FIG. 6 shows a section along the line VI—VI of FIG. 5. The magnetic elements 6.1 preferably are stainless steel magnets, and are positioned in a respective recess 9 of the face 7.1 of the extension 5.1 and are sealed in the recess 9 with a coverplate 10 which may be adhered at its peripheral portions to face 7.1, for example by means of an adhesive.

The splashguard of the present invention is preferably made of plastic material, e.g. environmentally acceptable polyethylenterphtalate (PET), such as is commonly used for containers. By means of a molding operation the splashguard (panel member 1, including possible stiffener ribs 3, flange 2, extension 5 or 5.1 with recesses 9) is fabricated from a single sheet of plastic (for example having a thickness of 0.5 to 2 millimeters) in a single operation. The glides 21, which are likewise made of plastic material, are preferably attached by means of plastic screws in holes provided for this purpose at the upper portion of the splashguard, for example as shown in FIGS. 2*a*–2*c*, 3 and 4. The entire splashguard, therefore, is comprised of non-corrosive components.

The flange 2 and the optional stiffener ribs 3 provide the splashguard with sufficient mechanical strength, thus making the commonly used aluminum frames unnecessary. It is also conceivable to provide recessed compartments on the panel member 1 which, for example, be used as soap dishes or storage areas. The splashguard can be fabricated using a deep drawing or vacuum forming method, and the moldability of the shape is kept within limits so that the resulting shaped finished product can be removed from the mold, pattern or die used to form the product.

Advantages of the splashguard of the present invention are ease of mounting, ease of removal without leaving any markings, and that stationary or permanent connections to the walls of the bathroom or to the rim of the bathtub are unnecessary. Moreover, the splashguard is made entirely of non-corrosive components and can be readily attended to for cleaning, etc., since there are no inaccessible places. The sheets of plastic from which the splashguards are made can be imprinted in any manner before the deep drawing or vacuum forming process. The use of polyethylenterephtalate allows additionally for exceptional environmentally acceptable disposal.

What is claimed is:

1. A movably suspended splashguard for a bathtub, comprising:

a substantially flat, substantially rectangular panel member (1) having a flange (2) adjoining and extending from said panel member at least laterally on the opposite sides thereof and on the bottom thereof;

the flange portion at the bottom of the splashguard being slidable on an upper surface (11) of a rim (12) of the bathtub;

said flange being directed inwardly toward the interior of the bathtub and having at least an outer edge portion which extends substantially perpendicular to said panel member of the splashguard; and said flange portion at the bottom of the splashguard having an extension (5), extending below the upper surface (11) of the rim (12) of the bathtub, said extension (5) having a magnetic means for magnetically adhering to an inner face (13) of the rim (12) of the bathtub to fix the position of the splashguard relative to the bathtub.

2. The splashguard of claim 1, wherein said flange includes a portion extending from the top of said panel member (1) so as to completely surround said panel member.

3. The splashguard of claim 2, wherein said flange (2) has at least one inner flange section (2.1) adjoining said panel member, and an outer flange section (2.2) extending from said inner flange section substantially perpendicular to said panel member (1).

4. The splashguard of claim 1, wherein said flange (2) has at least one inner flange section (2.1) adjoining said panel member, and an outer flange section (2.2) extending from said inner flange section substantially perpendicular to said panel member (1).

5. The splashguard of claim 3, wherein the inner flange section (2.1) is inclined relative to said panel member (1) at an angle ($\alpha$); and the outer flange section (2.2) is inclined relative to said inner flange section (2.1) so that it extends substantially perpendicular to said panel member (1).

6. The splashguard of claim 4, wherein the angle ($\alpha$) between said panel member (1) and said first flange section (2.1) is within the range of about 40° to about 75°.

7. The splashguard of claim 6, wherein said angle ($\alpha$) is about 60°.

8. The splashguard of claim 2, wherein said flange includes stiffening means around the upper edge portion of said panel member.

9. The splashguard of claim 1, wherein said extension (5) is located substantially at the center of the bottom flange portion and extends only over a portion of said bottom flange portion.

10. The splashguard of claim 1, wherein said extension (5) comprises a substantially flat member which is inclined relative to said panel member (1) such that it extends substantially parallel to an inner face of the rim of the bathtub.

11. The splashguard of claim 3, wherein said extension (5) has a flange (8) thereon which projects toward the interior of the bathtub and which extends substantially perpendicular to said panel member (1).

12. The splashguard of claim 11, wherein said flange (8) of said extension (5) is continuous with and blends into the outer flange section (2.2) of said panel member.

13. The splashguard of claim 1, wherein said extension (5) has at least one recess (9) therein, and further comprising at least one magnetic element (6) in said at least one recess.

14. The splashguard of claim 1, wherein said panel member, said extension and said flange are deep drawn from a sheet of plastic material.

15. The splashguard of claim 14, wherein said plastic material is polyethylenterephtalate (PET).

16. The splashguard of claim 1, wherein said panel member (1) includes mechanical reinforcement means (3).

17. The splashguard of claim 16, wherein said mechanical reinforcement means includes at least one elongated rib (3) on said panel member.

18. The splashguard of claim 1, further comprising:

an adjustable-length guiding means (20) which is mountable substantially parallel to the upper surface of the rim of the bathtub, between two walls of a room in which the bathtub is placed; and at least two spaced apart glide members (21) connected to the upper portion of said panel member of said splashguard;

said glide members being freely slidably engaged in said guiding means so as to be slidable relative to said guiding means.

19. The splashguard of claim 18, wherein said guiding means includes an adjustable-length guide rod having a channel therein for receiving said guide members.

* * * * *